United States Patent [19]

Akashi

[11] Patent Number: 4,984,338

[45] Date of Patent: Jan. 15, 1991

[54] ORNAMENTAL PULL TAB FOR SLIDE FASTENER SLIDERS

[75] Inventor: Shunji Akashi, Kurobe, Japan

[73] Assignee: Yoshida Kogyo K.K., Tokyo, Japan

[21] Appl. No.: 524,437

[22] Filed: May 17, 1990

[30] Foreign Application Priority Data

May 18, 1989 [JP] Japan ..... 1-57493[U]

[51] Int. Cl.[5] ..... A44B 19/26

[52] U.S. Cl. ..... 24/431; 24/419; 24/429

[58] Field of Search ..... 24/431, 419, 429, 430, 24/437, 405, 704.1; 294/3.6

[56] References Cited

U.S. PATENT DOCUMENTS 2,145,118 1/1939 Knoess .
4,193,172 3/1980 Kanizawa ..... 24/704.1
4,512,064 4/1985 Nishikawa ..... 24/429
4,704,770 11/1987 Minami et al. .
4,790,050 12/1988 Ishii ..... 24/429
4,823,447 4/1989 Akashi ..... 24/429
4,928,358 5/1990 Ishii et al. ..... 24/431

FOREIGN PATENT DOCUMENTS 2-71313 5/1990 Japan .

*Primary Examiner*—Victor N. Sakran
*Attorney, Agent, or Firm*—Hill, Van Santen, Steadman & Simpson

[57] ABSTRACT

An ornamental pull tab for slide fastener sliders is made from synthetic resin and has on its upper surface a desired pattern. The ornamental pull tab comprises a grip portion including a base plate having in the upper surface a recess in the form of the pattern and a pattern portion formed on the base plate by injection-molding synthetic resin into the recess.

4 Claims, 2 Drawing Sheets

ORNAMENTAL PULL TAB FOR SLIDE FASTENER SLIDERS

BACKGROUND OF THE INVENTION

1. Field of the Invention

The present invention relates generally to a slider for slide fasteners and more particularly to an ornamental pull tab pivotally attached to the slider to reciprocate the slider to open and close the slide fastener.

2. Description of the Prior Art

Heretofore, there has never existed any such pull tab as comprising a base plate made of a synthetic resin and an ornamental pattern molded thereon by injecting a different synthetic resin on the upper surface of the base plate. However, there was often seen a key for a personal computer of the construction described above. In manufacture of the key, first a base plate is made of a synthetic resin. As shown in FIG. 4, the base plate comprises a flat rectangular base plate proper A and a protuberant pattern portion B projecting on the upper surface of the base plate proper A to assume a pattern such as an alphabetical letter, a numeral and a symbol. In FIG. 4, the pattern portion B assumes the shape of the numeral 8. Then, as shown in FIG. 5, a different synthetic resin is injection-molded onto the remaining portions of the upper surface of the base plate proper A up to the level of the protuberant pattern portion B to thus provide a background portion C, against which the numeral 8 is clearly seen.

However, in this conventional key for personal computers, since the pattern portion B need to be formed protuberantly on the base plate proper A, it is very difficult to depict a complex pattern on the key.

Furthermore, in order to depict a pattern which involves an insular portion D such as the manual 8 shown in FIG. 4, the pattern portion B must have a guide channel E through which the synthetic resin is injected for forming the insular portion D. The necessity of providing such a guide channel E in the pattern portion B disadvantageously limits patterns to be depicted on the key.

Consequently, mere application of this method to an ornamental pull tab would not result in satisfactory effect.

SUMMARY OF THE INVENTION

With the foregoing drawbacks in view, it is therefore an object of the present invention to provide an ornamental pull tab for slide fastener sliders wherein a complex pattern can be formed thereon at accurately and a pattern involving an insular portion can be formed with ease.

According to the present invention, there is provided an ornamental pull tab, for being pivotally connected to the slider body of a slide fastener slider, made from synthetic resin and having on its upper surface a desired pattern, the ornamental pull tab comprising a grip portion including a base plate having in the upper surface a recess in the form of the pattern and a pattern portion formed on the base plate by injection-molding synthetic resin into the recess.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
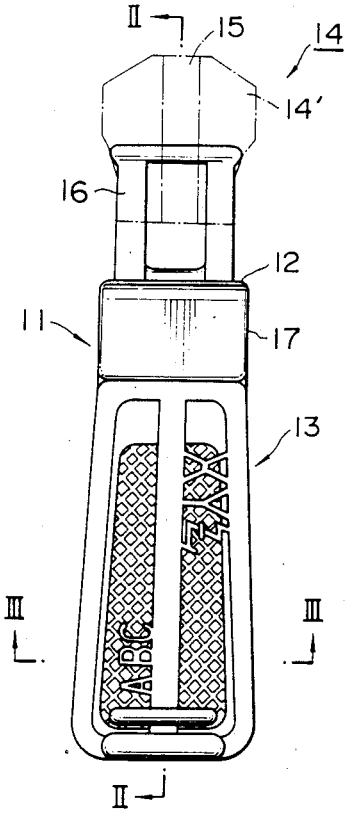
FIG. 1 is a plan view of a slide fastener sliders provided with an ornamental pull tab according to the present invention, with its slider body shown in phantom lines.
Figure 2:
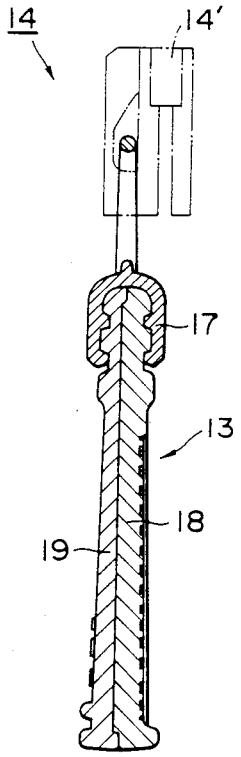
FIG. 2 is a longitudinal cross-sectional view taken on line II—II of FIG. 1.

FIG. 1 shows a slider 14 provided with an ornamental pull tab 11 according to the present invention. As shown in phantom lines in FIG. 1, in addition to the pull tab 11, the slider 14 includes a slider body 14' having a protuberant lug 15 provided on the upper surface thereof. As shown in FIG. 1, the ornamental pull tab 11 comprises a pull tab support 12 and a grip portion 13 joined with the pull tab support 12. The pull tab support 12 has at its one end a clamping portion 17 clamping the front end of the grip portion 13 and at the other end a loop portion 16 pivotally connected to the protuberant lug 15 on the slider body 14'.

The grip portion 13 is intended to be gripped by fingers of a user to manipulate the slider 14 for opening and closing the slide fastener. The grip portion 13 includes a base plate 18 and a plurality of pattern portions 19 formed on the base plate 18 to provide patterns thereon. The base plate 18 and the pattern portions 19 are made, through injection-molding, of synthetic resins which are capable of adhering to each other, such as acrylate resin, polycarbonate resin, nylon resin and ABS resin. The base plate 18 and the pattern portion 19 may be formed of either the same resin or different resins, and may be transparent or non-transparent.

Figure 3:
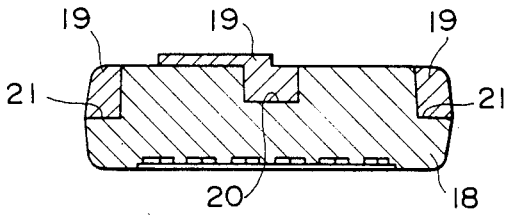
FIG. 3 is a lateral cross-sectional view taken on line III—III of FIG. 1.
Figure 4:
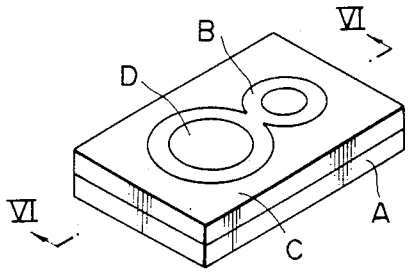
FIG. 4 RELATED ART
FIG. 4 is a perspective view showing a key for personal computers as a related art to the present invention.
Figure 5:
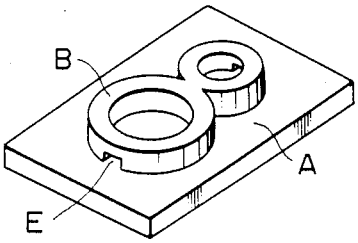
FIG. 5 RELATED ART
FIG. 5 is a perspective view of a base plate of the key of FIG. 4.
Figure 6:
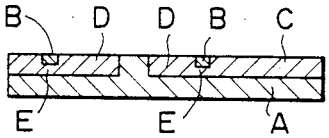
FIG. 6 RELATED ART
FIG. 6 is a longitudinal cross-sectional view taken on LINE VI—VI of FIG. 4.

The base plate 18 is formed by injecting molten synthetic resin into a mold (not shown) comprising an upper and a lower mold halves. In this instance, the base plate 18 is formed in its upper surface with recesses 20, 21 in the form of a desired pattern. After the mold is cooled, the upper mold half is removed. Subsequently, another upper mold half is placed on the lower mold half with the cavities of the former disposed in registry with the recesses 20, 21 of the base plate 18. Then, either transparent or non-transparent synthetic resin is injected into the cavities to provide a plurality of pattern portions 19. In FIG. 3, the pattern portions 19 protrudes slightly beyond the upper surface of the base plate 18. However, the pattern portion 9 may be formed with its upper surface held coplanar with the upper surface of the base plate 18.

With the construction of the present invention as set forth above, however complex patterns might be depicted, or even if the patterns involve an insular portion, they could be formed on the pull tab accurately and with great ease.

Furthermore, since the synthetic resin constituting patterns is filled in the recesses and hence is adhered to the base plate over increased area, the patterns are firmly retained on the base plate against accidental detachment, so that the ornamental pull tab can maintain its attractive appearance for prolonged period of time.

Obviously, various modifications and variations of the present invention are possible in the light of the above teaching. It is therefore to be understood that within the scope of the appended claims the invention may be practiced otherwise than as specifically described.

What is claimed is:

1. An ornamental pull tab, for being pivotally connected to the slider body of a slide fastener slider, made from synthetic resin and having on its upper surface a desired pattern, the ornamental pull tab comprising a grip portion including a base plate having in the upper surface a recess in the form of the pattern and a pattern portion formed on the base plate by injection-molding synthetic resin into the recess.

2. An ornamental pull tab according to claim 1, the base plate and the pattern portion being made from a same synthetic resin.

3. An ornamental pull tab according to claim 1, the base plate and the pattern portion being made from different synthetic resins, respectively.

4. An ornamental pull tab according to claim 1, further including a pull tab support joined at its one end with the grip portion and pivotally connected at the other end to the slider body.

* * * * *